US006858113B1

(12) United States Patent
Sekiya

(10) Patent No.: US 6,858,113 B1
(45) Date of Patent: Feb. 22, 2005

(54) POLLUTION PREVENTION METHOD FOR CYLINDRICAL DRYER USED IN PAPER MACHINE

(75) Inventor: Kunio Sekiya, Tokyo (JP)

(73) Assignee: Maintech Co., Ltd., Tokyo (JP)

( * ) Notice: Subject to any disclaimer, the term of this patent is extended or adjusted under 35 U.S.C. 154(b) by 0 days.

(21) Appl. No.: 09/806,090

(22) PCT Filed: Sep. 14, 1999

(86) PCT No.: PCT/JP99/05022

§ 371 (c)(1),
(2), (4) Date: Mar. 26, 2001

(87) PCT Pub. No.: WO00/19012

PCT Pub. Date: Apr. 6, 2000

(30) Foreign Application Priority Data

Sep. 25, 1998 (JP) ..... 10-288942

(51) Int. Cl.[7] ..... D21F 1/32

(52) U.S. Cl. ..... 162/199; 162/202; 427/194; 427/195

(58) Field of Search ..... 162/199, 202; 427/194, 195

(56) References Cited

U.S. PATENT DOCUMENTS 5,389,204 A * 2/1995 Ampulski ..... 162/135
6,277,242 B1 * 8/2001 Archer et al. ..... 162/111
6,454,901 B1 * 9/2002 Sekiya et al. ..... 162/111

FOREIGN PATENT DOCUMENTS

| | | | |
|---|---|---|---|
| EP | 1 124 005 | * | 8/2001 |
| JP | 4-130190 | | 5/1992 |
| JP | 6-280181 | | 10/1994 |
| JP | 7-292382 | | 11/1995 |
| JP | 7-292591 | | 11/1995 |
| JP | 07-292591 | * | 11/1995 |
| JP | 2000-345489 | * | 12/2002 |
| WO | WO 96/38628 | | 12/1996 |

* cited by examiner

*Primary Examiner*—N. Bhat
(74) *Attorney, Agent, or Firm*—Sughrue Mion, PLLC

(57) ABSTRACT

The invention provides a method of preventing contamination of a dryer of a paper machine so that a predetermined anti-fouling effect can always be ensured over a long term while maintaining satisfactory drying efficiency. With the method of preventing contamination of the surface of a drum dryer used in a paper machine, according to the invention, a predetermined amount of a surface forming agent P is continuously supplied to the surface of the drum dryer D1 in rotation, facing a paper strip W, while the paper strip W is being fed by the paper machine in operation.

7 Claims, 7 Drawing Sheets

POLLUTION PREVENTION METHOD FOR CYLINDRICAL DRYER USED IN PAPER MACHINE

TECHNICAL FIELD

The present invention relates to a method of preventing contamination of a drum dryer used in a paper machine (pollution prevention method for cylindrical dryer used in paper machine).

BACKGROUND OF TECHNOLOGY

In a paper machine, sheet-shaped wet paper is formed from feed stock, and the wet paper is processed into product paper by removing moisture from the former.

As drying is an essential step for removing moisture, a so-called dry part where a drying process is carried out plays a very important role.

The paper machine is equipped with a plurality of dryers for drying the wet paper, occupying the major part of the paper machine.

The dryers normally have a construction such that the dryers can be heated from inside thereof by introducing heated steam and so forth thereinto.

When moist paper undried as yet is fed to the dry part, the paper is pressed into contact with the surface of the dryers by touch rolls and canvases, and dried.

The surface of the dryers made of metal is generally a rough surface in microscopic terms, and especially since dryers made of casting are in widespread use, it is unavoidable that the surface thereof has such roughness.

Incidentally, paper contains pitch, tar component, and microfibers that are included in pulp feed stock itself, additive chemicals contained in various papers, and other components such as filler. When the paper is pressed against the surface of the dryers, those components described tend to gain adhesiveness due to the effect of heat, and to stick to the surface of the dryers.

For removal of contaminants stuck to the surface of the dryers such as the components described above, there has been normally adopted a method of scraping the contaminants off with a doctor blade, an accessory of the dryers.

However, this causes the surface of the dryers to become rougher due to friction occurring between the doctor blade and the surface of the dryers, the components described above make ingress into recesses in microscopic aspesrities on the rough surface, and stick thereto under the influence of heat and pressure. Then, parts of the surface of the wet paper are transferred to the dryers, and scraped off again with the doctor blade. Thus, there will occur a vicious cycle of the same phenomena being repeated.

As described in the foregoing, since in the case of conventional methods of making paper, the components described above stick to the dryers, and concurrently, the surface structure of paper is stripped off, the method incurs direct or indirect adverse effects caused by the components.

For example, technical problems as described hereinafter will be encountered;

1. Paper powders generated are mixed with products, and especially at the time of printing, transfer of ink to the surface of paper is blocked by the paper powders, causing the phenomenon called "counter" to occur.

2. Causes for unevenness and napping, occurring on the surface of product paper, and degradation in the surface strength of the product paper are created.

3. Thermal conductivity of the surface of the dryers becomes lower, degrading a drying rate of paper.

4. The phenomenon called "picking" whereby the surface of paper is peeled off occurs.

5. There will be an increase in the number of periodical clean-ups required of the dryers.

6. Sticking of paper to the surface of the dryers occurs, resulting in breaks of paper.

Accordingly, attempts have been made to overcome shortcomings as described above as much as possible by applying chromium plating or Teflon coating to the surface of the dryers beforehand, or by applying sufficient oil hardening treatment thereto periodically while the paper machine is out of operation.

However, in the former case, after surface-treated dryers have been in use over time, the treated surface thereof undergoes gradual wear due to friction, resulting in degradation in the effect of contamination prevention.

In the case of degradation in the effect taking place, it is required that the dryers should be replaced with new ones, or the surface thereof is ground, resulting in loss in operation time due to time required for replacement, or extra costs incurred.

Similarly, in the latter case, transfer of oil to paper takes place over time, and as a result, the beneficial effects of oil starts to decline, so that there will be a limitation to the merits of this method.

Thus, the beneficial effects over the long term can not be expected of either of the methods described in the foregoing, and both the methods are therefore not suited for continuous operation on the long term basis.

DISCLOSURE OF THE INVENTION

The invention has been developed in an attempt to solve various problems described in the foregoing.

It is therefore an object of the invention to provide a method of preventing contamination of the dryers of a paper machine so that predetermined effects of contamination prevention over the long term can always be ensured while maintaining satisfactory drying efficiency.

To this end, the inventors have carried out intense studies on the subjects, and discovered as a result that an exfoliative oil film can constantly be maintained on the surface of the dryers by supplying continuously the dryers with oil by a small amount as if oil was kneaded into the dryers. The invention has successfully been developed on the basis of this fact.

That is, the first aspect of the invention provides a method of preventing contamination of the surface of a drum dryer used in a paper machine, whereby a predetermined amount of a surface forming agent is continuously supplied to the surface of the drum dryer in rotation, facing a paper strip, while the paper strip is being fed by the paper machine in operation.

The second aspect of the invention provides a method of preventing contamination of the surface of a drum dryer, wherein the surface forming agent in the first aspect of the invention contains synthetic resin powders as the main constituent thereof.

The third aspect of the invention provides a method of preventing contamination of the surface of a drum dryer, wherein the surface forming agent in the second aspect of the invention further contains a surfactant.

The fourth aspect of the invention provides a method of preventing contamination of the surface of a drum dryer, wherein the surface forming agent in the second aspect of the invention further contains oil.

The fifth aspect of the invention provides a method of preventing contamination of the surface of a drum dryer, wherein the surface forming agent in the second aspect of the invention further contains a surfactant and oil.

The sixth aspect of the invention provides a method of preventing contamination of the surface of a drum dryer, wherein the surface forming agent in the second aspect of the invention wherein a particle size of the synthetic resin powders in the second aspect of the invention is in the range of from 0.1 to 10 $\mu$m.

The seventh aspect of the invention provides a method of preventing contamination of the surface of a drum dryer used in a paper machine, whereby synthetic resin powders are continuously supplied at a rate of 10 $\mu$g to 50 $\mu g/m^2$ per minute to the surface of the drum dryer in rotation, facing a paper strip, while the paper strip is being fed by the paper machine in operation.

The eighth aspect of the invention provides a method of preventing contamination of the surface of a drum dryer, wherein the drum dryer in any one of the preceding first to seventh aspects of the invention is a Yankee dryer.

The ninth aspect of the invention provides a method of preventing contamination of the surface of a drum dryer, wherein the drum dryer in any one of the preceding first to seventh aspects of the invention is multiple type drum dryers.

The tenth aspect of the invention provides a method of preventing contamination of the surface of a drum dryer used in a paper machine, said method comprising the following steps 1) to 5):

1) the step of supplying a surface forming agent containing synthetic resin powders to the surface of the drum dryer in rotation, facing a paper strip, while the paper strip is being fed by the paper machine in operation (synthetic resin powder supply step);

2) the step of filling up recesses in microscopic asperities on the surface of the drum dryer with the synthetic resin powders by supplying the surface forming agent containing the synthetic resin powders (asperities fill-up step);

3) the step of forming a synthetic resin film on the surface of the drum dryer with the recesses in the microscopic asperities thereof already filled up by continuous supply of the surface forming agent containing the synthetic resin powders (synthetic resin film forming step);

4) the step of transferring synthetic resin composing the synthetic resin film onto the paper strip by keeping the drum dryer and the paper strip a pressed in contact with each other, thereby depleting the synthetic resin film (synthetic resin transfer step); and 5) the step of replenishing the drum dryer with the synthetic resin by an amount of depletion of the synthetic resin film by continuous supply of an anti-fouling agent containing the synthetic resin powders after the depletion of the synthetic resin film (synthetic resin replenishing step).

The eleventh aspect of the invention provides a method of preventing contamination of the surface of a drum dryer used in a paper machine, said method comprising the following steps 1) to 6):

1) the step of supplying a surface forming agent containing synthetic resin powders to the surface of the drum dryer in rotation, facing a paper strip, while the paper strip is being fed by the paper machine in operation (synthetic resin powder supply step);

2) the step of filling up recesses in microscopic asperities on the surface of the drum dryer with the synthetic resin powders by supplying the surface forming agent containing the synthetic resin powders (asperities fill-up step);

3) the step of forming a synthetic resin film on the surface of the drum dryer with the recesses in the microscopic asperities thereof already filled up by continuous supply of a surface forming agent containing the synthetic resin powders and oil (synthetic resin film forming step);

4) the step of forming an oil film over the synthetic resin film by further supply of the surface forming agent containing the synthetic resin powders and the oil (oil film forming step);

5) the step of transferring synthetic resin composing the synthetic resin film and the oil composing the oil film onto the paper strip by keeping the drum dryer and the paper strip pressed in contact with each other, thereby depleting the synthetic resin film and the oil film (transfer step); and 6) the step of replenishing the drum dryer with the synthetic resin and the oil by an amount of depletion of the synthetic resin film and the oil film, respectively, by continuous supply of the surface forming agent containing the synthetic resin powders and oil after the depletion of the synthetic resin film and the oil film (replenishing step).

The method of the invention may comprise a combination of at least two methods, selected from a group of the above-mentioned methods (1) to (11) provided that the method serves the object of the invention. Operation By supplying the surface forming agent continuously by a predetermined amount onto the surface of the drum dryer, recesses in microscopic asperities on the surface thereof are filled up efficiently with the synthetic resin powders contained in the surface forming agent, so that the surface of the drum dryer is smoothed out.

By further continuing supply of the surface forming agent, the synthetic resin (film) layer is further formed on the surface of the drum dryer with the recesses in the microscopic asperities thereof, already filled up with the synthetic resin powders.

On one hand, synthetic resin of the synthetic resin layer formed on the surface of the drum dryer is transferred to the paper strip, and on the other hand, parts of the surface thereof, where the synthetic resin layer has been depleted, are replenished with new synthetic resin.

BEST MODE FOR CARRYING OUT THE INVENTION

Figure 1:
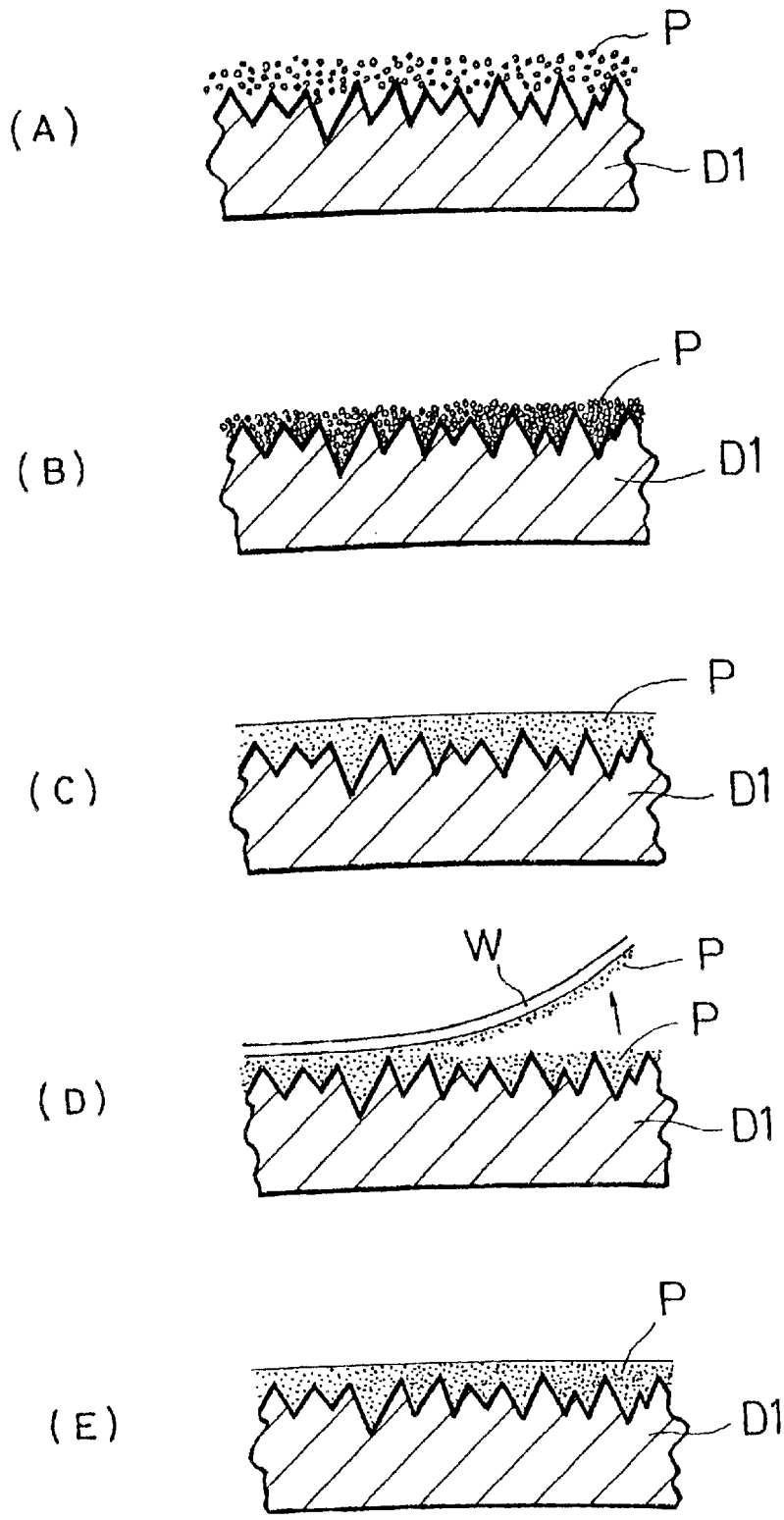
FIGS. 1A–E is a conceptual illustration showing how the surface of a dryer is treated.

Preferred embodiments of the present invention are described hereinafter with reference to the accompanying drawings.

A paper machine is normally provided with a dry part, and the dry part comprises heated drum dryers, canvases for pressing a paper strip into contact with the drum dryers, canvas rollers for guiding the canvases, and so forth.

A method of preventing contamination according to the invention is applied to the drum dryers assembled to the paper machine.

Contamination of the drum dryers can be prevented by supplying continuously a surface treatment agent by a predetermined amount to the surface of the drum dryers, facing paper.

Accordingly, the surface of the drum dryer is kept in a condition to have a film of a surface forming agent thereon.

In carrying out the invention, a surface forming agent containing synthetic resin powders as a main constituent is used.

Various types of synthetic resin powders can be used for the aforesaid synthetic resin powders, however, since the surface of a drum dryer is heated up to a high temperature (in the range from 50 to 120° C.), use of synthetic resin powders insusceptible to denaturation at such a temperature is preferable.

For example, melamine cyanurate (MCA) prepared by addition of an equal amount (by weight) of melamine and isocyanuric acid, polytetrafluoroethyelene, and so forth can be used for the synthetic resin powders, and particularly, melamine cyanurate (MCA) is preferable.

From the viewpoint of achieving high efficiency in filling up recesses in microscopic asperities on the surface of the drum dryer, the synthetic resin powders of particle size in the range of from 0.1 to 10 $\mu$m are used, and a particle size in the range of from about 1 to 5 mm is more preferable.

If the particle size is smaller than 0.1 $\mu$m, a fill-up condition becomes unstable, and if the particle size is larger than 10 $\mu$m, it will become difficult to fill up the recesses in the microscopic asperities on the surface of the drum dryer.

A synthetic resin powder content of from 1 to 20 percent by weight relative to the surface forming agent is adopted.

It is important that the surface forming agent is prepared by addition of a surfactant to the synthetic resin powders to improve dispersivity, so that spraying as described hereinafter can be facilitated.

A mixing ratio of the surfactant, in the range of from 15 to 60 percent by weight relative to the synthetic resin powders, is adopted, and the surface forming agent is prepared normally by addition of water 5 to 100 times (by weight) as much as the synthetic resin powders to the synthetic resin powders with the surfactant mixed as above.

Further, in preparing the surface forming agent, addition of various additives such as an oil (solid wax included) based dusting inhibitor, a polymer based adhesive for promoting adhesion of wet paper onto the surface of the dryer, and so forth to an aqueous dispersion described above is practiced depending on the type of paper to be manufactured.

In actually supplying the surface forming agent onto the surface of the dryer, a spray nozzle or spray nozzles are employed, and for preventing the spray nozzle/nozzles from getting clogged, further dilution (on the order of 10-to 100-fold) of the surface forming agent with water is also practiced before the surface forming agent is put to use.

In such a case, water used for dilution is preferably heated up to 50 to 80° C. in order to minimize clogging of the spray nozzle/nozzles with scum and slime. Consequently, it is natural that the surface forming agent is heated up to a similar temperature.

As for a supply rate (or a spray rate) of the surface forming agent containing the synthetic resin powders, it is required that same is sprayed little by little on the surface of the dryer, and the supply rate in terms of the synthetic resin powders is 10 mg to 50 mg/m$^2$ per minute, preferably 30 $\mu$g to 10 $\mu$g/m$^2$ per minute.

If the supply rate is less than 10 $\mu$g/m$^2$ per minute, recesses in microscopic asperities on the surface of the drum dryer can not be filled up sufficiently (particularly, in the case of a Yankee dryer wherein scraping by a doctor takes place, a higher supply rate is required in comparison with the case of multiple drum-dryers), and if the supply rate exceeds 50 mg/m$^2$ per minute, the synthetic resin powders in excessive supply causes contamination of paper and peripheral facilities.

Now, a series of steps for supplying the surface forming agent containing the synthetic resin powders onto the surface of the drum dryer, facing paper, are described hereinafter.

FIG. 1 is a schematic illustration showing how treatment on the surface of the drum dryer is provided.

1) Synthetic Resin Powder Supply Step

As the canvas is caused to act so as to press a paper strip at a given pressure against the drum dryer when the drum dryer is supplied with the surface forming agent P containing the synthetic resin powders, the synthetic resin powders supplied onto the drum dryer is adhered to the surface of the drum dryer (refer to A in the figure).

2) Asperities Fill-up Step

The synthetic resin powders adhered to the surface of the drum dryer proceed to fill up the recesses in the microscopic asperities (rough surface) of the drum dryer as a result of continuous supply of the surface forming agent P containing the synthetic resin powders (refer to B in the figure).

In this case, since the synthetic resin powders are in the form of a particulate, the synthetic resin powders are allowed to make ingress into the recesses in the microscopic asperities on the surface of the drum dryer with ease.

3) Synthetic Resin Film Forming Step

As the surface forming agent P containing the synthetic resin powders is still being supplied to the surface of the drum dryer, already smoothed out by the synthetic resin powders filling up the recesses in the microscopic asperities thereof, a thin synthetic resin film (on the order of several microns in thickness) is formed on the surface of the drum dryer due to the effect of heat and pressure (refer to C in the figure).

4) Synthetic Resin Transfer Step

Meanwhile, as the synthetic resin film formed on the surface of the drum dryer is kept pressed by the paper strip W being fed, synthetic resin proceeds to be transferred little by little constantly to the paper strip W (transfer phenomenon).

As a result, the synthetic resin film formed on and adhered to the surface of the drum dryer undergoes gradual depletion (refer to D in the figure).

5) Synthetic Resin Replenishing Step

However, as supply of the surface forming agent containing the synthetic resin powders onto the drum dryer still continues, the drum dryer is immediately replenished with the synthetic resin powders by an amount of reduction due to the depletion described (refer to E in the figure).

Meanwhile, reduction of the synthetic resin powders and replenishment thereof are indistinguishable from each other, and occur concurrently in conjunction with each other.

As described above, by supplying the surface forming agent containing the synthetic resin powders continuously to new portions of the surface of the drum dryer in rotation during operation of the paper machine, the steps 1) to 3) described above are carried out in the initial stage of operation.

Then, by further continuing supply of the synthetic resin powders, the steps 4) and 5) described above are carried out.

Thus, by going through each of five steps consisting of the synthetic W resin supply step, the asperities fill-up step, the synthetic resin film forming step, the synthetic resin transfer step, and the synthetic resin replenishing step, the surface of the drum dryers is maintained in a condition such that a given synthetic resin film is constantly formed, enabling the paper machine to withstand continuous operation satisfactorily.

With the method according to the invention, there will occur no decline in anti-fouling effect after operation of the paper machine over time, unlike the case of a conventional method using drum dryers with an anti-fouling treatment applied to the surface thereof beforehand.

In the case of the surface forming agent containing an oil-bearing dusting inhibitor besides the synthetic resin powders, oil is invariably pushed up on top the surface of the synthetic resin film, and formed into an even and very thin oil film.

As the oil film has a function of filling up recesses in microscopic asperities formed on the synthetic resin film, the drum dryers will have a better mold-release characteristic against contamination.

Incidentally, the surface of the drum dryer with the oil film described above formed thereon presents a mirror-like surface appearance.

As described hereinbefore, the spray rate of the surface forming agent containing the synthetic resin powders, which needs be sprayed little by little on the surface of the dryer, is to be in the range of from 10 $\mu$g to 50 mg/m$^2$ per minute in terms of the synthetic resin powders.

Results of spray tests conducted are shown hereinafter.

EXAMPLE 1

Figure 2:
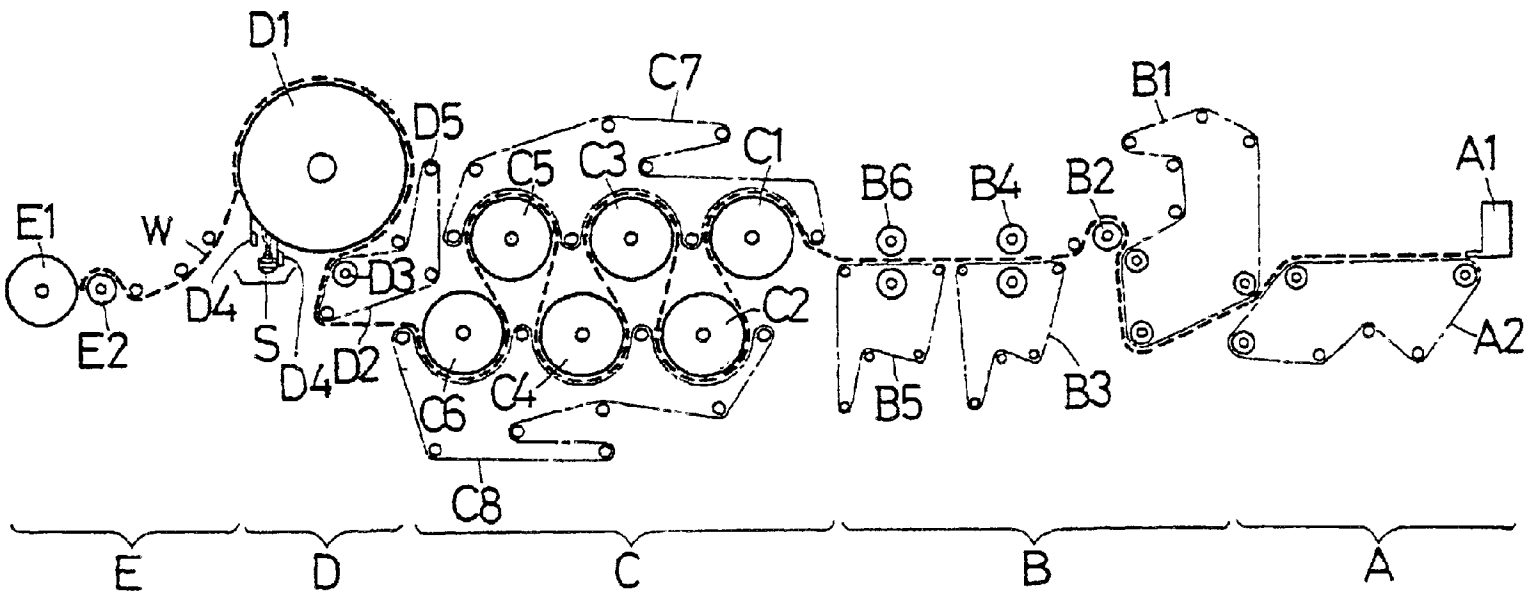
FIG. 2 is a schematic representation of a standard paper machine comprising a wire part, a press part, and a dryer part.
Figure 6:
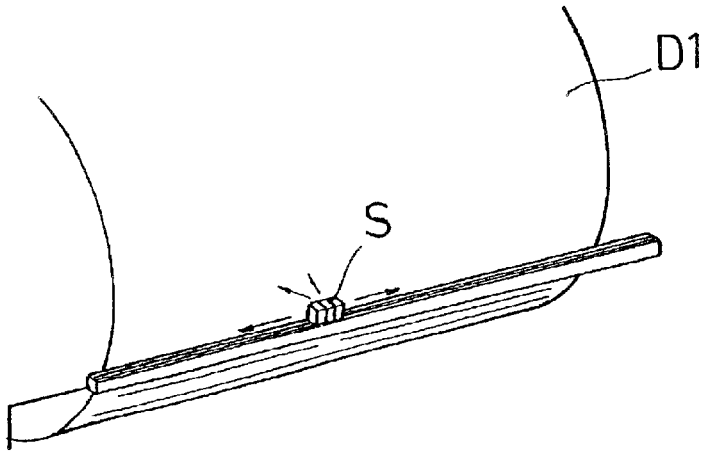
FIG. 6 is a view showing a state of spraying the surface forming agent through a movable type spray nozzle.

With a multiple drum-dryer and Yankee-dryer composite type paper machine (manufactured by Mitsubishi Heavy Industries Co., Ltd.) as shown in FIG. 2, test operation was carried out for a month, wherein a surface forming agent was continuously sprayed onto the surface of a Yankee dryer through a nozzle of a spray apparatus shown in FIG. 6, and upon completion of tests, the condition of the surface of the dryer as well as paper (one-side glazed paper) produced was observed.

(Surface Forming Agent Used)

A surface forming agent used in the tests was an emulsified aqueous solution prepared by diluting a mixture composed of the synthetic resin powders (MCA) 3 $\mu$m in average particle size and a surfactant mixed at we. ratio of 10:5 with water 50 times as much as the mixture (density at about 1.0 g/cc).

(Spray Rate)

3 cc /min

In this case, the size of an area of the surface of the dryers with which a paper strip is pressed into contact was 70 m$^2$ and a supply amount of the synthetic resin powders for a unit area per minute was:

3 cc/min×1.0 g/cc÷50×10/(10+5)÷70 m$^2$=5.7×10$^{-4}$ g/m$^2$ per min=0.57 mg/m$^2$ per min.

(Results)

Figure 8:
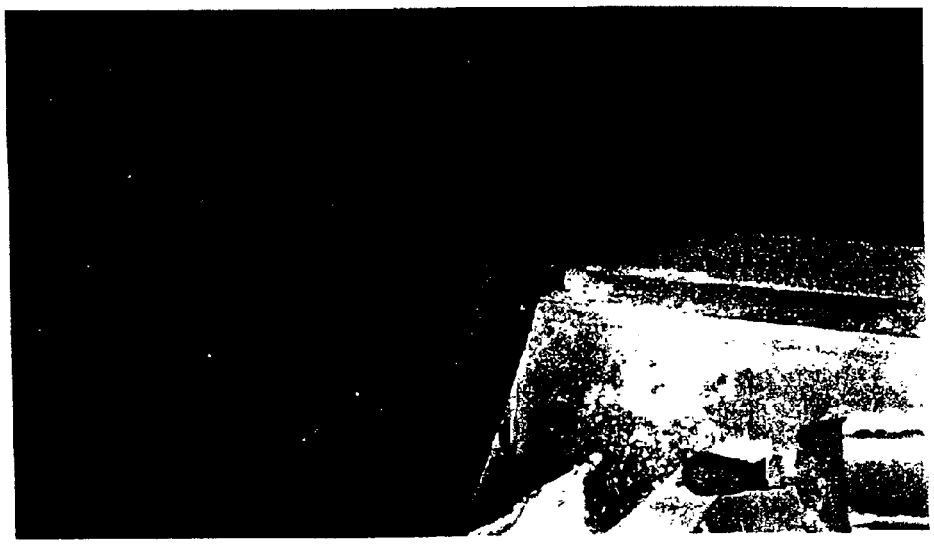
FIG. 8 is a photograph showing the results of tests according to an example 1.

The results showed that the surface of the dryers had no adhesive material, presenting a mirror-like appearance and an amount of paper powders generated was reduced to less than one tenth of that before application of the technology of the invention (refer to FIG. 8).

EXAMPLE 2

With a Yankee-dryer type paper machine (manufactured by K. K. Kawanoe Machinery), test operation was carried out for a month, wherein a surface forming agent was continuously sprayed onto the surface of the dryer through nozzles of a spray apparatus, shown in FIG. 4, and upon completion of tests, the condition of the surface of the dryer was observed.

(Surface Forming Agent Used)

A surface forming agent used in the tests was an emulsified aqueous solution prepared by diluting a mixture composed of the synthetic resin powders (MCA) 3 $\mu$m in average particle size, a surfactant and a polymer based adhesive, mixed at wt. ratio of 10:3:5, with water 50 times as much as the synthetic resin powders (density at about 1.0 g/cc).

(Spray Rate)

4 cc/min (provided that spraying was made over the entire surface of the dryer while the surface forming agent is diluted with water supplied at 2000 cc/min together with a remover such as mineral oil, supplied at 5 cc/min)

In this case, the size of an area on the surface of the dryer with which a paper strip is pressed into contact was 20 m$^2$ and a supply amount of the synthetic resin powders for an unit area per minute was:

4 cc/min×1.0 g/cc÷50÷20 m$^2$=4×10$^{-3}$ g/m$^2$ per min=4 mg/m$^2$ per min.

(Results)

The results showed that scratches formed on the surface of the dryer were buried under the synthetic resin powders, and the surface of the dryer presented a mirror-like appearance.

EXAMPLE 3

With a multiple drum-dryer type paper machine (manufactured by K. K. kobayashi Seisakusho), test operation was carried out for a month, wherein a surface forming agent was continuously sprayed onto the surface of the dryers through a nozzle of a spray apparatus, shown in FIG. 6, and upon completion of tests, the condition of the surface of the dryers was observed.

(Surface Forming Agent Used)

A surface forming agent used in the tests was prepared by mixing the synthetic resin powders (MCA) 3 $\mu$m in average particle size in an amount of 0.02 wt. percent relative to a wax based dusting inhibitor into the wax based dusting inhibitor (density at about 1.0 g/cc).

(Spray Rate)

6 cc/min

In this case, the size of an area on the surface of the dryers with which a paper strip is pressed into contact was 20 m$^2$ and a supply amount of the synthetic resin powders for an unit area per minute was:

6 cc/min×1.0 g/cc×0.02×$10^{-2}$÷20 $m^2$=DTMF decoder 6×$10^{-5}$ g/$m^2$ per min=60 μm/$m^2$ per min.

(Results)

Figure 9:
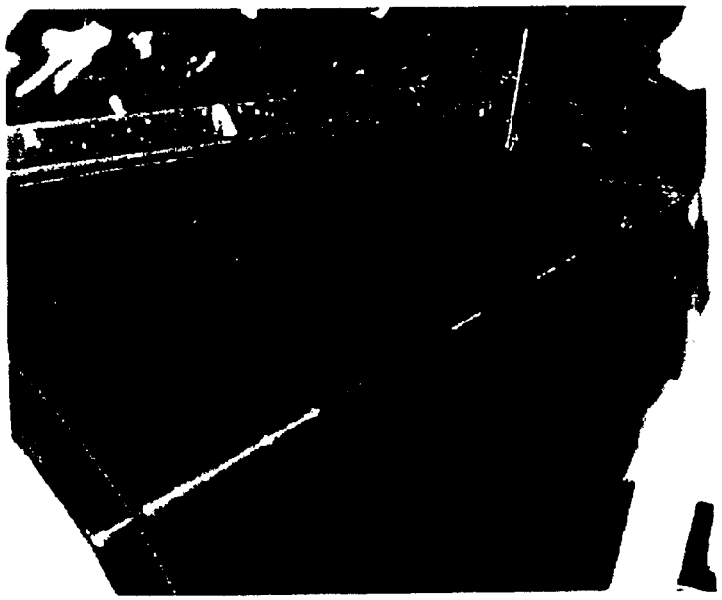
FIG. 9 is a photograph showing the results of tests according to an example 3.

The results showed that the surface of the dryers had no adhesive material, presenting a mirror-like appearance, and an amount of paper powders generated was reduced to less than one tenth of that before application of the technology of the invention (refer to FIG. 9).

With the examples described in the foregoing, there were two cases where the surface forming agent was sprayed through the nozzle. That is, in one case, the surface forming agent was heated up to 50 to 80° C. immediately before spraying, and in the other case, the surface forming agent was kept at room temperature (on the order of 23° C.).

Test results showed that in the case of spraying at room temperature, the nozzle was clogged up frequently (once a week or once every other week) while in the case of heating up the surface forming agent, no clogging of the nozzle occurred, enabling efficient spraying to be carried out.

Comparative Example 1

With a Yankee-dryer type paper machine, test operation was carried out for a month, using a dryer with anti-fouling treatment applied thereto by plasma spraying, and upon completion of tests, the condition of the surface of the dryer was observed.

(Results)

Figure 10:
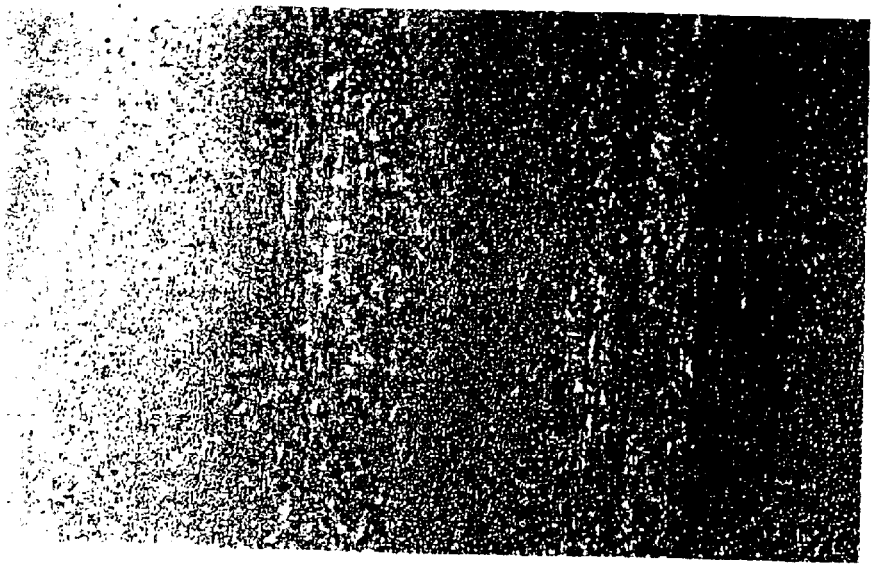
FIG. 10 is a photograph showing the results of tests according to a comparative example 1.

The results showed that the surface of the dryer underwent wear and tear to a fair degree, and a multitude of pits on the order of 1 mm in diameter were found on the surface (refer to FIG. 10).

Comparative Example 2

With a multiple drum-dryer type paper machine, test operation was carried out for a month using dryers the surface of which oil quenching was applied to, and upon completion of tests, the condition of the surface of the dryers as well as paper produced (newspaper) were observed (Results)

Figure 11:
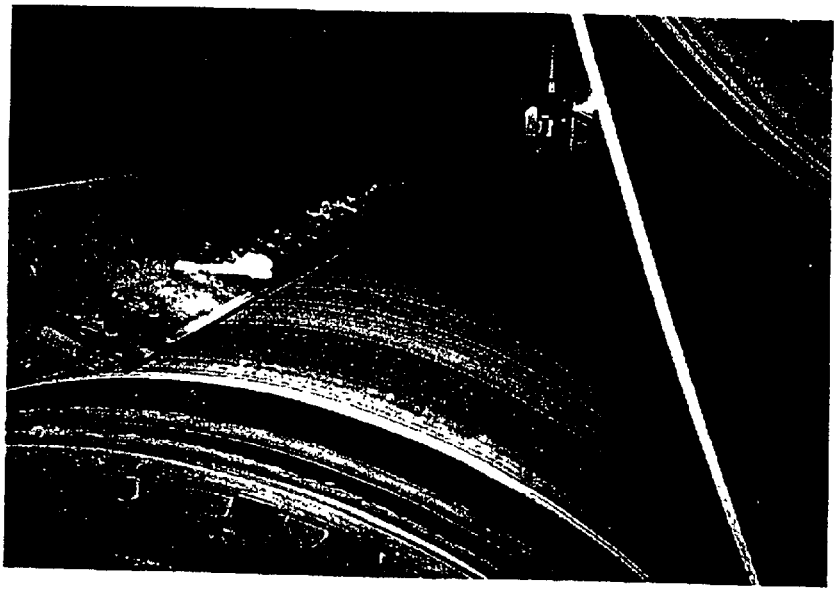
FIG. 11 is a photograph showing the results of tests according to a comparative example 2.

The results showed that oil on the surface of the dryers was substantially depleted, and paper powders were found adhered to the periphery of the dryers (refer to FIG. 11).

Also paper powders, pitch, and so forth were found adhered to the surface of the paper produced, and a large amount of paper powders were found accumulating at the doctor.

Comparative Example 3

After test operation was carried out under the same conditions as for the example 2 for a month, the condition of the surface of the dryer at that point in time was observed (observation 1).

By increasing a spray rate of only the surface forming agent 5-fold, 10-fold, 15-fold, and 20-fold, respectively, every five hours, while keeping the spray rate of the remover and water for dilution at the initial level, the surface condition of the dryer was observed, and the quality of a paper strip (liner) produced during tests was also inspected (observation 2).

(Spray Rate)

20, 40, and 60 cc per min, respectively (Supply Amount of the Synthetic Resin Powders)

20, 40, and 60 mg/$m^2$ per min, respectively (Results)

The results showed that the mirror-like surface condition of the dryer as observed upon observation 1 was still observed at the time of observation 2 until the spray rate was increased to 40 cc per min (the supply amount of the synthetic resin powders at 40 mg/$m^2$ per min), however, it was found that at the spray rate of 60 cc per min (the supply amount of the synthetic resin powders at 60 mg/$m^2$ per min), scraping of the synthetic resin powders in excess supply by the doctor started, and the periphery of the dryer was contaminated with agglomerates of the synthetic resin powders.

Comparative Example 4

After test operation was carried out under the same condition as for the example 3 for a month, the condition of the surface of the dryers at that point in time was observed (observation 1).

By decreasing gradually the content of the synthetic resin powders as described below every 5 hours while maintaining the spray rate of the surface forming agent constant, the surface condition of the dryers was observed (observation 2).

(Spray Rate)

constant at 60 cc/min (Supply Amount of the Synthetic Resin Powders)

50,40,30,20,10,5,0 μg/$m^2$ per min, respectively (Results)

The results showed that the mirror-like surface condition of the dryers as observed upon observation 1 was still observed at the time of observation 2 until the spray rate was decreased to 30 μg/$m^2$ per min.

According as the supply amount of the synthetic resin powders was decreased from 30 μg/$m^2$ per min to 20 μg/$m^2$ per min, and then to 10 μg/$m^2$ per min, luster on the surface of the dryers became more dull, however, a marked change in an amount of paper powders generated was not observed.

When the supply amount came down as low as 5 μg/$m^2$ per min, the surface of the dryers lost luster, and an amount of paper powders generated increased two-fold, making little difference from a case of the synthetic resin powders not being added (that is, with the supply amount of the synthetic resin powders at 0 μg/$m^2$ per min, and with addition of a common dusting inhibitor only).

Now a paper machine to which the technology of the invention is applied, and dryers thereof are briefly described, FIG. 2 shows a standard paper machine comprising a wire part A, a press part B, and dryer parts C, D.

The operation of the paper machine in whole is briefly explained as follows.

In the wire part A, feed stock (pulp) is fed from a head box A1 onto a Fourdrinier wire A2, dewatered, and formed into a paper strip in a sheet-like shape.

In the press part B, the paper strip is squeezed from the upper side as well as the underside by rolls B2, B4, B6, and endless belts B1, B3, B5, thereby moisture thereof being reduced.

In the dryer parts C, D, moisture contained in the paper strip is given off due to the effect of heat of dryers C1, C2, C3, C4, C5, and C6.

In the dryer parts wherein a Yankee dryer part D is installed after a predryer part C, two-stage drying is performed.

In the predryer part C, the paper strip W is squeezed between canvases C7, C8, and the dryers C1, C2, C3, C4, C5, C6, and dried.

Figure 3:
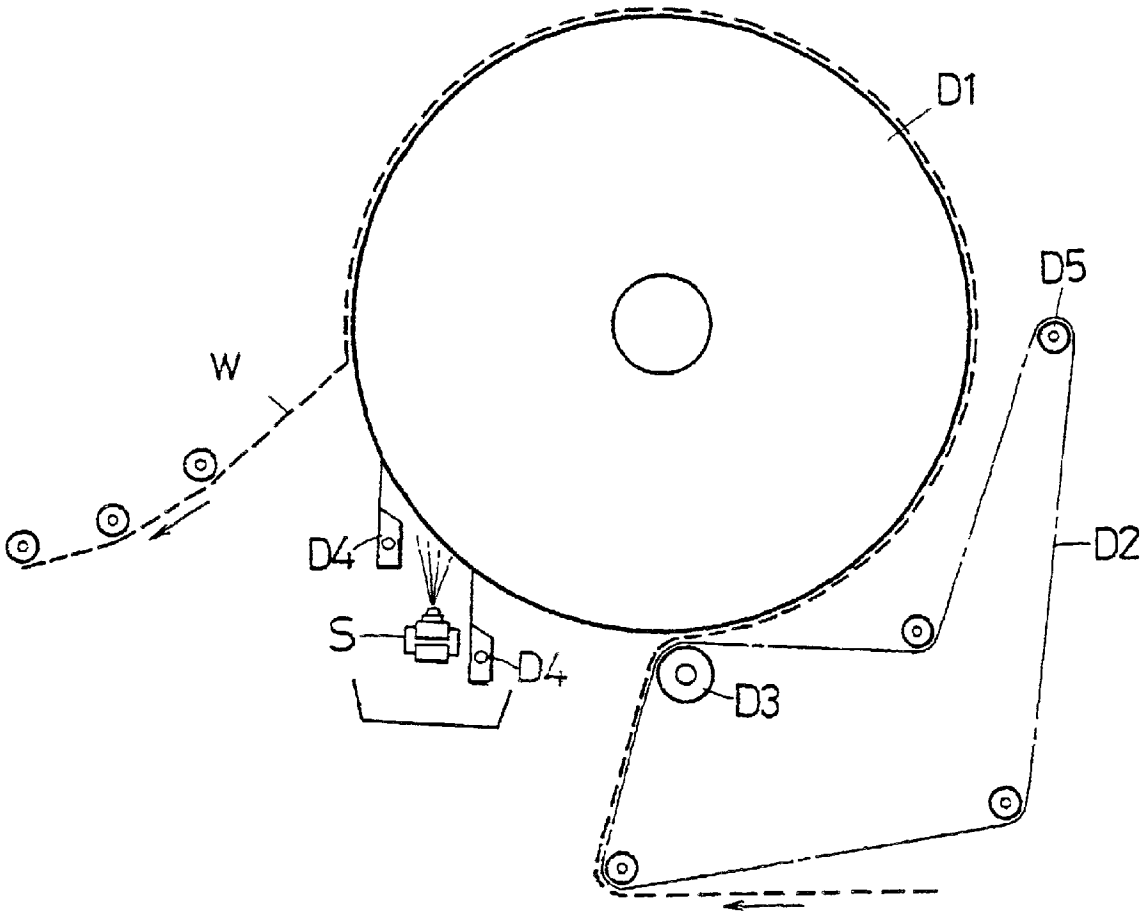
FIG. 3 is an enlarged view of a Yankee dryer part of the paper machine.

FIG. 3 is an enlarged view of the Yankee dryer part D.

The Yankee dryer part D comprises a Yankee dryer D1, a touch felt D2, a touch roll D3, a doctor D4, an auxiliary roll D5, and so forth. The Yankee dryer D1 is provided with an internal heat source, and heated up to an appropriate temperature, for example, to a surface temperature in the range of 110 to 120° C. A temperature to which the surface of the Yankee dryer D1 is heated up, however, varies somewhat depending on the type of paper, an areal weight, a paper feed rate, and so forth.

Now the paper strip is stuck to the touch felt D2, and immediately thereafter, squeezed hard between the Yankee dryer D1 and the touch roll D3, so that the paper strip is stuck to the surface of the Yankee dryer D1 and rotated.

Along with rotation of the Yankee dryer D1, the paper strip is transferred, and then peeled away by a take-up force of a reel drum E1 from the surface of the Yankee dryer D1 at a point where the paper strip is transferred by 270° from the position opposite to the touch roll D3.

The Yankee dryer D1 and the doctor D4 are juxtaposed with a given spacing therebetween, and the doctor D4 serves to remove adherents on the surface of the Yankee dryer D1 more effectively by continuous scraping of the adherents while being pressed into contact with the surface of the Yankee dryer D1.

The surface forming agent containing the synthetic resin powders is sprayed over the surface of the Yankee dryer D1 at a position between a point where the paper strip is peeled way from the surface of the Yankee dryer D1 and the touch roll D3 (refer to FIG. 3).

For specific means for such spraying, an optimum one depending on the location of spraying is adopted.

Figure 4:
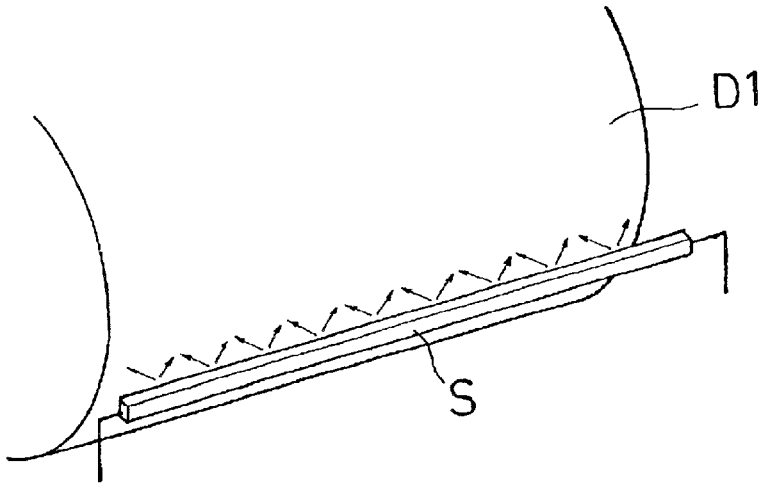
FIG. 4 is a view showing a state of spraying a surface forming agent through spray nozzles disposed lengthwise.
Figure 5:
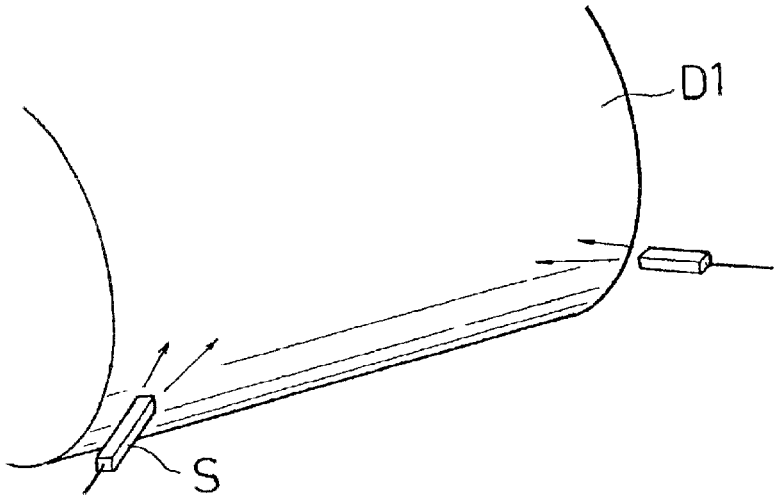
FIG. 5 is a view showing a state of spraying the surface forming agent through fixed type spray nozzles.
Figure 7:
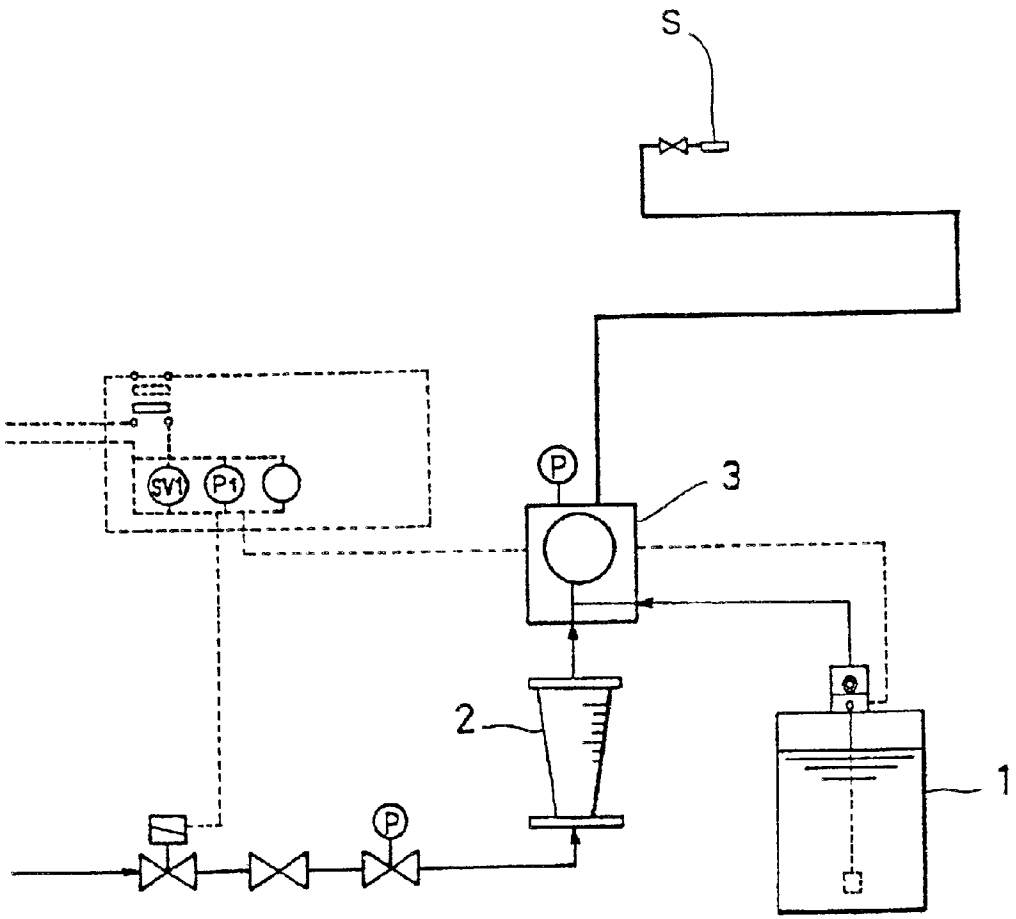
FIG. 7 is a view showing an exemplary construction of a chemical spray unit comprising a spray nozzle.

FIGS. 4 to 6 are schematic illustrations showing various means of spraying. FIG. 4 is a view showing a state of spraying by use of spray nozzles disposed lengthwise, FIG. 5 a view showing a state of spraying by use of fixed type spray nozzles, and FIG. 6 a view showing a state of spraying by use of a movable spray nozzle, and Here, for reference, FIG. 7 shows an exemplary construction of a chemical spray unit comprising a spray nozzle.

With the chemical spray unit, the surface forming agent delivered from a chemical tank 1 is sprayed onto the surface of the dryer through a spray nozzle S.

Water may be taken in via a flow meter 2 as necessary, and mixed with the surface forming agent by a mixer 3, so that water can be sprayed simultaneously through the spray nozzle S.

While the preferred embodiments of the invention have been described in the foregoing, it is to be understood that the scope of the invention is not limited thereto, and various other modifications may be made without departing from the spirit or scope of the invention.

For example, in the embodiments described hereinbefore, the method according to the invention is applied to the Yankee dryer and the multiple type dryers, however, the scope of the invention is not limited thereto, and it goes without saying that the invention can be adapted to other types of dryers.

Industrial Applicability

Although the invention is a technology applied to a drum dryer used in a paper machine, it can be utilized in the entire technical field for manufacturing paper which is expected to have the same effect as the invention.

What is claimed is:

1. A method of preventing contamination of the surface of a drum dryer used in a paper machine, whereby a predetermined amount of a surface forming agent which contains synthetic resin powders as the main constituent thereof, and oil is continuously supplied to the surface of the drum dryer in rotation, facing a paper strip, while the paper strip is being fed by the paper machine in operation.

2. A method of preventing contamination of the surface of a drum dryer used in a paper machine, whereby a surface forming agent which contains a predetermined amount of synthetic resin powders as the main constituent thereof, and a surfactant and oil is continuously supplied to the surface of the drum dryer in rotation, facing a paper strip, while the paper strip is being fed by the paper machine in operation.

3. A method of preventing contamination of the surface of a drum dryer according to claim 1 or 2, wherein a particle size of the synthetic resin powders is in the range of from 0.1 to 10 $\mu$m.

4. A method of preventing contamination of the surface of a drum dryer used in a paper machine, whereby synthetic resin powders are continuously supplied at a rate of 10 $\mu$g to 50 mg/m$^2$ per minute to the surface of the drum dryer in rotation, facing a paper strip, while the paper strip is being fed by the paper machine in operation.

5. A method of preventing contamination of the surface of a drum dryer according to claim 1 or 2, wherein the drum dryer is a Yankee dryer.

6. A method of preventing contamination of the surface of a drum dryer according to claim 1 or 2, wherein the drum dryer is multiple type drum dryers.

7. A method of preventing contamination of the surface of a drum dryer used in a paper machine, said method comprising the following steps 1) to 6):

1) the step of supplying a surface forming agent containing synthetic resin powders to the surface of the drum dryer in rotation, facing a paper strip, while the paper strip is being fed by the paper machine in operation (synthetic resin powder supply step);

2) the step of filling up recesses in microscopic asperities on the surface of the drum dryer with the synthetic resin powders by supplying the surface forming agent containing the synthetic resin powders (asperities fill-up step);

3) the step of forming a synthetic resin film on the surface of the drum dryer with the recesses in the microscopic asperities thereof already filled up by continuous supply of a surface forming agent containing the synthetic resin powders and oil (synthetic resin film forming step);

4) the step of forming an oil film over the synthetic resin film by further supply of the surface forming agent containing the synthetic resin powders and the oil (oil film forming step);

5) the step of transferring synthetic resin composing the synthetic resin film and the oil composing the oil film onto the paper strip by keeping the drum dryer and the paper strip pressed in contact with each other, thereby depleting the synthetic resin film and the oil film (transfer step); and 6) the step of replenishing the drum dryer with the synthetic resin and the oil by an amount of depletion of the synthetic resin film and the oil film, respectively, by continuous supply of the surface forming agent containing the synthetic resin powders and oil after the depletion of the synthetic resin film and the oil film (replenishing step).

* * * * *